United States Patent [19]

Chow

[11] Patent Number: 4,512,218

[45] Date of Patent: Apr. 23, 1985

[54] CONTROL BAR FOR RATCHET WRENCH

[76] Inventor: Kirk K. Chow, 5902 Bent Trail Dr., Dallas, Tex. 75248

[21] Appl. No.: 591,029

[22] Filed: Mar. 19, 1984

[51] Int. Cl.[3] ..... B25B 13/46

[52] U.S. Cl. ..... 81/62; 81/63

[58] Field of Search ..... 81/60, 61, 62, 63, 177 G

[56] References Cited

U.S. PATENT DOCUMENTS

| | | | |
|---|---|---|---|
| 2,544,795 | 3/1951 | Knudsen | 81/63 |
| 2,772,763 | 12/1956 | Johnson | 81/62 |
| 3,233,481 | 2/1966 | Bacon | 81/63 |
| 3,265,171 | 8/1966 | Kilness | 81/63 |
| 3,393,587 | 7/1968 | Jolliff et al. | 81/177 R |

*Primary Examiner*—Frederick R. Schmidt
*Assistant Examiner*—J. T. Zatarga
*Attorney, Agent, or Firm*—Michael G. Berkman

[57] ABSTRACT

In a ratchet wrench of the type having a head which is manually rotatably shiftable for reversing the driving direction or torque-transmitting mode of a socket carried by the wrench and in which the head is also manually depressible to effect release of a socket carried by a drive stud of the wrench, an improved control bar or lever for rotating the head of the wrench to effect socket drive reversal. The control bar surmounts and is attached to the head for pivotal manipulation thereof. An integral end portion of the control bar extends radially beyond a bounding periphery of the head to provide increased torque forces and enhanced ease of manual annular shifting of the head and of the socket drive direction control components coupled thereof. A free end of the control bar is spaced from the wrench to permit depressing the head manually to effect the release of a wrench-carried drive socket.

10 Claims, 4 Drawing Figures

CONTROL BAR FOR RATCHET WRENCH

The present invention relates to an improved ratchet drive reversing lever or bar for a socket drive wrench. More particularly, the invention is directed to a socket drive control bar for providing increased torque forces and enhanced ease of manual annular shifting of the head of a ratchet wrench and of the socket drive direction control components coupled thereto.

BACKGROUND OF THE INVENTION

Many types of ratchet wrenches and tools of related utility have been described in the relevant art. Such socket wrenches are widely used to drive any of a selectable number of sockets, and many of the wrenches are provided with means by which the torsional drive direction of the wrench itself may be readily reversed. In a great number of the various ratchet drive wrenches currently available the mode of drive reversal is rotatably to shift a bar or pin or rod affixed to a head or face plate of the wrench whereby an operative pawl is shifted between a first mode which effectuates driving in one annular direction to a second mode which reverses the direction of annular drive. A generally common feature of many ratchet drive wrenches is that they include, at the driving boss or stud which engages the driven socket, a detent often taking the form of a ball or pellet. Some of the wrenches include the additional feature of being able to effect a simple quick release of the detent by means of what has been referred to as a "push button" release mechanism. Examples of such mechanisms are shown in Roberts U.S. Pat. No. 3,208,318, Joliff U.S. Pat. No. 3,393,587, and Hasnar U.S. Pat. No. 3,532,013. The disclosures of these patents are hereby specifically incorporated herein by reference to the extent that they are not inconsistent herewith. The latter two of the patents also describe mechanisms by which the rotational drive mode of the wrenches is conveniently reversed.

A typical direction drive reversing pawl-actuating mechanism is shown in Rueb U.S. Pat. No. 2,188,846.

Referring more particularly to ratchet wrenches of the type which embody both the feature of ratchet drive reversibility by means of a rotatable bar in combination with quick release socket capabilities, it will be appreciated that the latter feature necessitates the utilization of a spring mechanism to bias the detent control shaft and related components to a detent-restraining position in which the detent or ball is urged into locking engagement with the socket seated on the drive boss, stud, or shank of the ratchet wrench. One of the effects of this mechanical arrangement, and typically as illustrated in Joliff U.S. Pat. No. 3,393,587, is that the spring which biases the socket release assembly inherently impresses what results in a frictional load on the rotary mechanism by which the driving direction of the ratchet wrench is reversed. As a result, it is necessary to apply greater rotational force to the finger-actuated ratchet direction control bar or rod in order to rotate the internal mechanisms and to shift the internal pawl. It is to the resolution of this problem in wrenches of the type in which rotation of the head effects the direction drive reversal and in which depression of the head effects a release of the socket carried by the wrench that the present invention is directed.

SUMMARY OF THE INVENTION

The present invention finds utility in a ratchet wrench of the type which utilizes a rotatably shiftable head which is manually selectively positionable to provide two driving modes for the socket which is carried by the striving stud or boss of the wrench itself. In a preferred embodiment of the invention, the rotatable head is also depressible inwardly into the body of the wrench for actuating a shaft-like rod formed with a camming face or surface for controlling the positioning of a detent ball or pellet. The detent-controlling shaft is normally biased in an upwardly displaced position by means of a compression spring, and in that position the cam of the control mechanism urges the detent ball radially outwardly to engage and lock with a face of the socket positioned on the drive stud of the wrench. When the head of the wrench is depressed inwardly, the detent control rod and the camming face thereof permit the detent ball to be retracted radially inwardly and to disengage from the drive socket.

In the specific preferred embodiment of the invention incorporating the dual functions referred to, the force applied in rotating the head of the wrench must overcome not only the friction associated with the drive reversing elements but also the frictional force generated by the socket release assembly biasing spring.

Conventionally, the required head rotation is accomplished by means of a rod or bar which is attached to or is otherwise coupled to the head itself. Such rods are invariably well within the radial limits of the rotating head and, accordingly, are relatively short and, therefore, difficult to grip. In some of the prior art wrenches, the bar itself moves axially inwardly into the head when manually depressed in actuating the quick socket release features of the wrench. Again, the head rotating control bar is relatively short and is difficult to grasp and manipulate.

It is a principal feature of the invention that it provides, in a ratchet wrench of the type having a rotatable head for reversing the drive mode of the wrench, an improved head rotating control bar which obviates the shortcomings of prior art structures. A critical structural feature of the head rotating control bar of the invention is that it extends beyond the radial limits of the rotating head itself.

A related feature of the invention is that the head rotating control bar projects upwardly of the face of the rotating head a substantial and significant distance so that, this feature in combination with the radially extending feature of the control bar enables the operator of the wrench to shift the rotating head without gripping the control bar but merely by using either the thumb or a finger to displace the end of the control bar arcuately and, thus, rotate the head of the wrench.

In a preferred embodiment of the invention the face of the rotating head is essentially at the same level as the circumscribing ring-like housing which contains the shiftable pawl and related driving components of the wrench. In this preferred embodiment, in order to facilitate the axially inward displacement of the head in releasing the drive socket, the end of the improved control bar of the invention is formed with a cut-out section on the underside thereof in a zone of the bar which extends radially beyond the head and overlies the ring-like body of the ratchet wrench.

While the cutaway feature of the control bar of the invention constitutes an element utilized in the specific embodiment of the ratchet wrench illustrated in the present case, it will be appreciated that in wrenches of the type in which the rotatable core extends axially above the supporting housing, no cut-out is required.

An important feature enhancing the ease of operation and manipulation of the depressible and rotatable head of the ratchet wrench is that the control bar of the invention which surmounts the pivotal and depressible head has a top surface which does not parallel the head or top face of the wrench itself. Rather, the top surface of the control bar is contoured to angle upwardly as viewed toward the cut-out end of the control bar. In a preferred physical configuration, the upwardly projecting top surface of the control bar defines a concave curvature for accommodating the thumb of the user of the wrench whereby thumb pressure applied to the control bar and transferred to the depressible head establishes a principal force vector which is directed axially into the wrench head.

A related feature of the control bar of the invention is that its top surface is contoured to deter one's thumb from sliding forwardly and off of the control bar during application of head-depressing thumb pressure to the ratchet wrench.

Yet another feature of the control bar of the invention is that the bar includes a lineal sector having a transverse width of a substantial expanse to enhance the ease of impressing head-depressing force thereto for effecting axial displacement of the rotatable and depressible head of the ratchet wrench.

In a preferred embodiment of the invention the control bar is generally wedge-like or V-shaped as seen in a top plan view. This physical configuration facilitates a palpable identification of the orientation of the control bar of the invention.

In a preferred embodiment of the invention the control bar is integral with the face plate of the rotatable head of the ratchet wrench, this configuration contributing to the mechanical strength of the structure and providing clean lines contributing to the overall aesthetically pleasing appearance of the wrench.

In a preferred embodiment of the invention, the advantageous features are incorporated in a ratchet drive of the type which includes a driving ring or collar to which a handle is connected and a driven core or body rotatably journaled within the drive collar and coupled thereto through a shiftable pawl. The ratchet wrench in which the preferred embodiment of the invention finds utility also includes a quick release mechanism actuated through the application of axial pressure inwardly on the head of the wrench.

In accordance with the practice of the present invention the noted shortcomings of prior art structures have been obviated, and a simple yet highly functional and practical device has been provided. In particular, the present invention makes it possible for the user of the ratchet drive conveniently and quickly to effect not only an arcuate rotation of the head of the wrench, but also an axial displacement thereof, each operation being conveniently carried out with one's thumb and obviating the need for retrieval of the wrench and resort to a two-hand operation, which includes the step of gripping the control bar to achieve the desired rotation. In effect, arcuate rotation of the head is accomplished, as desired, without relinquishing control of the wrench and by using the same hand in which the tool is held.

Other and further objects, features, and advantages of the invention will become evident upon a reading of the following specification taken in conjunction with the drawing.

DESCRIPTION OF PREFERRED EMBODIMENT

Figure 1:
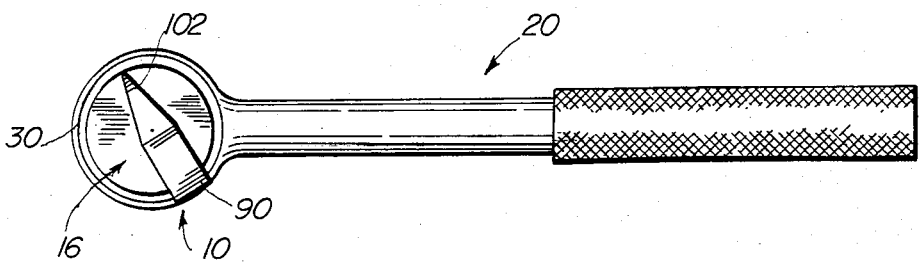
FIG. 1 is a top plan view of the manually depressible, annularly pivotal, drive direction determinating control bar of the invention surmounting and extending radially of the head of a ratchet wrench and shiftable and depressible with the head.
Figure 2:
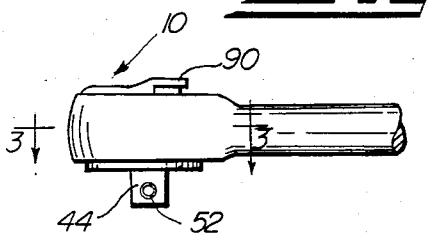
FIG. 2 is a side elevational view showing the depressible socket-releasing head and control bar of the invention in an upwardly biased socket-securing mode.
Figure 3:
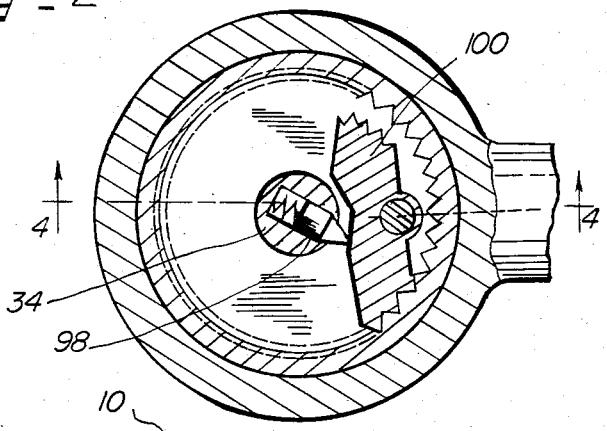
FIG. 3 is an enlarged cross-sectional view taken substantially on the line 3—3 of FIG. 2 and showing an internal pivotal pawl and a control-bar-actuated, annularly-shiftable pin for selectively reversing a drive mode of the pawl.

The aims, objects and advantages of the invention are achieved by providing, as part of a ratchet drive wrench, an improved drive head control bar. The bar serves selectively rotatively to pivot the head of the wrench annularly (to control the drive direction of a wrench-carried drive socket). The control bar serves also selectively to displace the wrench head axially inwardly (to release the drive socket carried by a drive stud of the wrench). The control bar of the wrench is characterized in that it is of an enhanced length, that length extending beyond a diametric limit of a rotatable head of the wrench. The elongated control bar provides a significantly increased manipulative mechanical advantage to the user of the wrench and enables the user digitally to reverse the drive mode of the wrench using the same hand in which the wrench is being held during use. As an additional feature, the top surface of the control bar is contoured to ensure non-slip positive digital engagement as the bar and the wrench head therebeneath are urged axially inwardly of the wrench head to overcome socket detent spring bias and to release a wrench-carried drive socket. The underside of a radially outwardly projecting portion of the control bar is relieved to obviate mechanical interference as the wrench head is pushed "in" to effect release of a socket.

Referring now to the drawing, there is shown for illustrative purposes and not in any limiting sense, one preferred embodiment of the ratchet drive control bar of the invention incorporating the features thereof.

The internal structure of the wrench core assembly and the associated pivotal pawl and tooth driving ring in ratchet wrenches in which the present invention is useful is not critical. Such internal structures do not constitute, per se, critical elements of the present invention. Such structures are well known in the art and are not shown or described in detail herein. The present invention finds utility, generally, in a broad class of ratchet wrenches. Practice of the invention is not dependent upon or keyed to any particular pawl and drive ring configuration. Rather, the present invention is useful with all ratchet wrenches in which the drive direction is reversed by annularly pivoting a head-mounted hand-actuated control bar. The invention finds utility as well in such drive assemblies in which a wrench-held drive socket is releasable by displacing the wrench head axially inwardly of the wrench body.

In the specific example depicted, the control bar 10 is mounted on and integrally secured to a rotatable and depressible head 16 of a ratchet wrench 20. The head 16 and its dependingly associated core assembly 24 are journalled in a generally cylindrical driving ring or collar 30, in a conventional manner.

Figure 4:
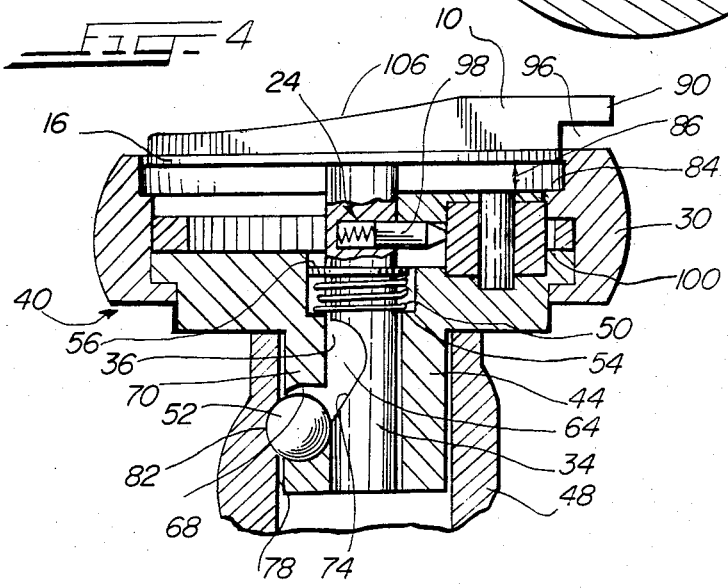
FIG. 4 is an enlarged cross-sectional view taken substantially on the line 4—4 of FIG. 3 and depicting, schematically the control bar of the invention in a functionally elevated socket-securing disposition defining a standby orientation, and showing ratchet wrench head internal structures coupled mechanically to and responsive to rotation and to depression manipulation of the control bar.

As shown schematically, in FIG. 4, the head-mounted control bar 10 is coupled through the core assembly 24 to an axially extending probe or shaft 34. The latter projects through a generally tubular core or channel 36 in a body 40 of the wrench and into a stud or boss 44 for driving a socket 48.

The ratchet wrench retention and releasing elements include, in addition to the shaft or pin 34, a shaft-encircling and supporting spring 50 and a pin-controlled bearing or detent ball 52. The spring 50 is confined between a fixed base wall or shoulder 54 in the body 40 of the wrench 20 and an undersurface of a collar 56 fastened on the shaft 34. The spring 50 functions to bias the probe 34 upwardly within the core 36 of the wrench as indicated schematically in FIG. 4.

The lower portion 60 of the shaft 34 is provided with a cutout, dished zone 64 opening laterally and constituting a recess for receiving the lock-ball or bearing 52 radially inwardly when the shaft 34 is urged axially downwardly (by downward pressure applied to the bar 10) to a socket-release orientation. The socket locking and release ball 52 is confined to shift laterally within a mating transverse bore 68 in the annular wall 70 of the driving boss 44. The bore 68 has a reduced diameter at its outer limit. The mechanical construction obviates escape of the ball 52 outwardly from the assembly.

A face of the cutout 64 in the shaft 34 defines a cam surface 74 which extends upwardly and inwardly along a line extending from a lower to an upper zone. Thus, in the upwardly-biased, normal or standby disposition of the release pin 34, a lower portion of cam surface 74 urges the locking ball 52 radially outwardly for functional inter-engagement with an abutting wall 78 of a selectable drive socket 48. Conventionally, the socket 48 is formed with a depression or dimple 82 on each of its bounding interfaces for mating mechanical inter-engagement with the lock-ball 52. As best seen in FIG. 4, with the locking pin assembly in its upwardly biased position, the cam surface 74 of the probe-like shaft 34 releasably urges the detent ball 52 into the dimple 82 to retain the socket 48 firmly fixed in place.

When the probe assembly is urged downwardly or axially inwardly into the wrench body 40 against the biasing pressure of the spring 50, the receding portion of the cam surface 74 is brought into juxta-position with respect to the detent ball 52, whereupon the ball 52 is free to retract radially inwardly into the driving stud 44 to effect disengagement with the sleeved socket 48. The latter then slides freely from the driving stud 44, and is released.

In the drive-socket-engaging mode of the wrench, the head 16 and its surmounting control bar 10 are displaced physically upwardly through the action of the biasing spring 50. As shown in FIG. 4, the collar-like body 30 of the wrench 20 is formed with a crater-like dished depression or recess 84 having a bounding peripheral contour and a vertical depth 86 dimensioned telescopically and slidably to receive therewithin the disc-like head 16 of the wrench 20 when digital pressure is applied to the control bar 10 and the head is forced axially downwardly against the pressure of the biasing spring 50. At the same time, the shaft 34 assumes a socket-releasing mode in which the detent ball 52 is freed for entry into the cutout portion 64 in the lower part 60 of the shaft 34.

An end 90 of the control bar 10 of the invention extends beyond the radial limit of the wrench head 16 and overlies the collar 30, as shown in FIG. 4. In order to accommodate the upstanding circumscribing peripheral ring 94 of the collar 30, the underside of the bar extension 90 is cut away 96, thus permitting downward displacement of the wrench head control bar assembly when a drive socket 48 is being released. The increased length of the control bar enables the user of the wrench to apply greater rotational torque to the head 16 so as more quickly and more positively to rotate the head 16 and the pawl-shifting pin 98 coupled thereto to shift the pawl 100 and to reverse the pawl and thus the drive direction of the wrench.

The physical arrangement described permits one to change drive direction, using the same hand in which the wrench is being held.

In a preferred embodiment of the invention the control bar 10 tapers from a wider width at its radially outwardly projecting end 90 to a more narrow width at its opposite end 102. The top surface 106 of the control bar 10 is contoured to accommodate positive digital engagement. Specifically, a shown in FIG. 4, the top surface 106 angles upwardly as viewed radially outwardly from the central concavity toward the radially projecting end 90. The control bar 10 is, thus, generally wedge-shaped as viewed in side elevation (FIG. 4).

While the foregoing description of the invention has been made with reference to a preferred embodiment, persons skilled in the art will understand, in the light of the present disclosure, that numerous changes, modifications, and alterations may be made therein without departing from the spirit and scope of the appended claims.

What is claimed is:

1. In a ratchet wrench having a rotatably shiftable head for selectively reversing a driving direction of a socket carried by a driving stud of the wrench, a head-encircling driving collar, and control bar means surmounting said head and secured thereto for manually pivotally manipulating said head to assume a selectable driving mode of said wrench, the improvement wherein said control bar means includes an integral end portion projecting radially beyond a circumscribing bounding periphery of said head and overlying said collar to provide enhanced ease of annular shifting of said head and increased applied rotational torque thereto during and changing of a driving mode of said ratchet wrench, and wherein said radially projecting end portion of said control bar means overlying said collar is spaced upwardly of said collar permitting physical displacement of said head axially inwardly within said collar of said wrench upon manual application of depressing force to said head for releasing a socket carried by said wrench.

2. The improvement as set forth in claim 1 wherein said control bar means is formed with a cut-out section on an underside thereof, said cut-out section being in a segment of said control bar means extending radially beyond said head and defining a recess between said control bar means and said collar for permitting telescoping displacement of said head inwardly into said collar of said wrench in response to a depressing force applied to said head axially to release a socket carried by a driving stud of said ratchet wrench.

3. The improvement as set forth in claim 1 where said control bar means is of an inconstant width along its linear expanse.

4. The improvement as set forth in claim 3 wherein said control bar means tapers from a wider width at its radially outwardly projecting end to a more narrow width at an opposite end of said control bar means.

5. The improvement as set forth in claim 1 wherein said control bar means includes a top surface which angles upwardly as viewed radially outwardly from a center point of said head toward a radially projecting end of said control bar means.

6. The improvement as set forth in claim 1 wherein said control bar means includes a top surface which includes a segment defining a concave contour.

7. The improvement as set forth in claim 1 wherein said control bar means projects above said rotatably shiftable head of said wrench, and wherein said control bar means is generally wedge-shaped as viewed in side elevation.

8. In a ratchet wrench having a rotatably shiftable head in a circumscribing collar for selectively reversing a drive direction of a socket carried by a driving stud of the wrench, and a control bar surrmounting said head and secured thereto for manually rotationally shifting said head to effect a selectable driving mode of said wrench, the improvement wherein said control bar includes an integral end portion projecting radially beyond a circumscribing bounding periphery of said head and overlying said collar to provide enhanced ease of annular shifting of said head and increased applied rotational torque thereto through forces applied to said control bar during the changing of a driving mode of said ratchet wrench, said end portion of said control bar being spaced upwardly of said collar and being formed with a cut-out under portion facilitating physical displacement of said control bar and said head to shift said head axially inwardly of said wrench upon manual application of depressing force to said head for releasing a socket carried by a driving stud of said wrench.

9. The improvement as set forth in claim 8 wherein said control bar is of an inconstant width along its linear expanse, and wherein said control bar tapers from a wider width at its radially outwardly projecting end to a more narrow width at an opposite end of said control bar.

10. The improvement as set forth in claim 8 wherein said control bar projects above a head of said wrench, said control bar being generally wedge-shaped as viewed in side elevation, and including a top surface which angles upwardly as viewed radially outwardly from a center point of said head toward a radially projecting end of said control bar, with a segment of said top surface defining a concave contour.

* * * * *